US007562797B2

(12) United States Patent
Senn et al.

(10) Patent No.: US 7,562,797 B2
(45) Date of Patent: Jul. 21, 2009

(54) LEFT HANDED HOLSTER LINKAGE

(75) Inventors: Tony Senn, Boise, ID (US); Taylor Jenkins, Nampa, ID (US)

(73) Assignee: Tactical Design Labs, Inc., Boise, ID (US)

( * ) Notice: Subject to any disclaimer, the term of this patent is extended or adjusted under 35 U.S.C. 154(b) by 682 days.

(21) Appl. No.: 11/056,348

(22) Filed: Feb. 11, 2005

(65) Prior Publication Data

US 2006/0180620 A1 Aug. 17, 2006

(51) Int. Cl.
*F41C 33/00* (2006.01)
*F41C 33/02* (2006.01)

(52) U.S. Cl. ..... 224/243; 224/192; 224/193; 224/198; 224/244

(58) Field of Classification Search ..... 224/243, 224/192, 193, 196, 244, 912, 913, 911, 242, 224/245; 211/64
See application file for complete search history.

(56) References Cited

U.S. PATENT DOCUMENTS

| | | | | |
|---|---|---|---|---|
| 3,866,811 | A * | 2/1975 | Hamby | 224/244 |
| 5,269,448 | A * | 12/1993 | Shoemaker | 224/243 |
| 5,944,239 | A * | 8/1999 | Rogers et al. | 224/193 |
| 6,230,946 | B1 * | 5/2001 | Vor Keller et al. | 224/244 |
| 2005/0035163 | A1 * | 2/2005 | French et al. | 224/243 |
| 2005/0040195 | A1 * | 2/2005 | Lowe et al. | 224/243 |

* cited by examiner

*Primary Examiner*—Nathan J Newhouse
*Assistant Examiner*—Lester L Vanterpool
(74) *Attorney, Agent, or Firm*—Robert L. Shaver; Dykas, Shaver & Nipper, LLP

(57) ABSTRACT

The invention is a security holster configured for use by left-handed users, with a release tab on the left side of the holster, a locking tab on the right side of the holster, which generally engages the ejection port of a gun, and a linkage between the release tab and the locking tab.

13 Claims, 15 Drawing Sheets

LEFT HANDED HOLSTER LINKAGE

PRIORITY

This application claims the priority date of the provisional application entitled Left Handed Holster Linkage filed by Senn, et al. on Feb. 11, 2004 with application Ser. No. 60/544,035.

DESCRIPTION

BACKGROUND OF THE INVENTION

1. Field of the Invention

The present invention generally relates to security holsters, and more particularly relates to security holsters configured for use with handguns having an ejection port, a slide, a handle, a trigger, and a trigger guard. The present invention is an improved security holster that is configured for use by left-handed individuals.

2. Background Information

Police, security officers, and military personnel in a number of situations must be ready to withdraw and use a handgun in the line of duty at a moment's notice. In an emergency situation, withdrawing the handgun must be done in a completely natural and unobstructed manner so that it can be withdrawn as quickly as possible. The officer's life may depend on the speed with which he can withdraw the handgun. However, after the handgun is withdrawn, the situation may dictate other options or needs, requiring the officer to re-holster the handgun just as quickly. Current holsters do not meet this demand, without some continued manipulation of security straps, before the officer knows or has confidence that the weapon is secure. In this type of situation, the officer needs to be able to holster his handgun with one hand without looking at the holster, and while maintaining eye contact with the person in question.

The problem results when a suspect becomes an assailant, and attacks the officer and tries to gain access to his weapon. In the event of an attack, a holster is likely to be bumped, jostled, pried, and pressured with forces exerted on nearly any part of the holster. Some holsters have release mechanisms that may be accidentally engaged during such an assault, releasing the weapon from the effective grip of the holster. When an assailant attacks, it is of utmost importance that the officer maintains control of his handgun, and that the assailant does not get access to the handgun. Many holsters have been designed to accomplish this purpose in a number of different manners. However, they all suffer a number of drawbacks. Some require two hands to release and secure the handgun. This is unacceptable. Some of them secure the handgun with a device that can be difficult to release in a fast draw situation, and therefore is a dangerous security mechanism. Some holsters secure the weapon in place to keep it from bouncing out of the holster, but are not designed to withstand the attack of an assailant and would allow the handgun to be taken from the officer by the assailant. Some holsters use electronic devices for fingerprint recognition and run the risk of malfunctioning or having a dead battery. Some holsters require the user to tilt or rock the handgun, or twist it before it can be released from the handgun. Such a maneuver must be practiced frequently in order to ensure that the wearer can perform it without mistake in an emergency situation. Many of the holsters are unable to address the above-mentioned problems or provide a security holster for a left-handed user. Additionally, many holster using groups desire to have a uniform pattern for their equipment. Some groups use specific patterns and symbols to identify a user's equipment and identity. Most security holsters provide no manner in which the holsters can be customized or individualized for an individual or specific group. All of the above named difficulties are problems that face a security holster user, and an improved security holster is needed which solves these problems.

For these reasons, it is an object of the present invention to provide a security holster for use by left-handed and right-handed users, which allows a handgun to be quickly inserted or withdrawn with one hand without looking at the holster, and which secures the holster to the officer without undue manipulation of the handgun. It is a further goal of the invention that the security holster and corresponding locking and releasing mechanisms prevent an unauthorized withdrawal of the handgun due to an accident or during an assault on the wearer. It is a further object of the invention to provide a handgun-securing holster that is easily released by a natural and fluid motion of the officer whether left or right-handed. It is a further object of the invention to provide a security holster that may be fluidly inserted or removed from the holster. Another object of the invention is to provide a security holster that may be effectively customized with adhesive inlays for standardization and matching purposes. Another object of the invention is to require a minimum compression force that must be exerted on the security holster in order to engage and disengage the locking mechanism for a handgun.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention allows a left handed individual to access and release a firearm from a security holster by utilizing the index finger of his or her left hand. As is shown in the accompanying drawings, described in this description, and described in the attached claims, the holster of the present invention is made up of a holster body having substantially rigid sidewalls forming an inner shell and defining an inner space. This inner space or cavity has an open portion for receiving a handgun within the holster and for removing the handgun from the holster. An optional thumb sheath covers a portion of the holster and engages and holds the thumb in a desired position. A locking tab is rotatably attached to the holster body. The locking tab is configured to allow the handgun to be positioned within the security holster and, upon insertion of the handgun into the holster, to engage a feature of the handgun until released. Therefore, the locking tab prevents the withdrawal of the handgun prior to the release of the locking tab. The present invention also includes a release tab accessible to the left hand index finger, which is operatively connected to the locking tab, and is configured to release the locking tab from the handgun feature by moving the locking tab in relation to the holster. The release tab is operatively connected to the locking tab through a linkage, which allows the release tab to be positioned on the opposite side of the holster body as compared to the position of the locking tab.

The present invention includes various linkages, which allow the release tab to be positioned on the opposite (left) side of the holster from the locking tab (right side) and providing a linkage that transfers movement of the release tab over to the locking tab so as to remove the locking tab from engagement with a designated feature of the hand gun. In the preferred embodiment of the invention, this feature is the ejection portion of the handgun. This invention provides a novel advantage over the prior art in that the release of the locking tab may be caused by the movement of the index finger of the left handed shooter rather than the thumb of the left handed shooter. This provides a more natural response and allows for increased efficiency and comfort in the use of a handgun by a left handed shooter.

In a first embodiment of the present invention, the linkage is a mechanical connection configured to go over the top or crown of the holster. Various types of linkages may be utilized to accomplish this result. In one embodiment shown in the attached drawings, the linkage is a U-shaped tube comprising springs that hold the U-shaped tube at a desired level of tension and compression against the release tab and the locking tab. When the release tab is compressed, the springs tension the linkage and exert a force upon the locking tab. The locking tab is then released from the feature of the handgun, preferably the ejection port, and the handgun is allowed to be withdrawn from the holster. The U-shaped tube may be a rigid tube, or may be articulated with hinges. It may be a tube, a rod, a bar, or other physical shapes.

In the configuration of the invention described above, the release tab is located on a release lever. The release lever is a third class lever, with a fulcrum end, a force supplied by the user in the middle of the lever, and motion in parted at the second end of the lever to move the U-shaped release tube. Since the other end of the U-shaped release tube is connected to the locking lever, movement of the release lever also moves the locking lever. In this configuration of the linkage of the invention, the locking tabs located on a locking lever, with the locking lever being a second class lever. It has a fulcrum on the first end. The force is applied to the second end of the lever, and motion is imparted to the locking tab which is located between the two ends.

In other of these over the top embodiments, other devices besides a U-shaped tube could be utilized. These include, but are not limited to, linkage connections that connect the release tab to the locking tab through a bell crank, also called a rotating bar. This bell crank then appropriately transfers movement to the locking tab thus releasing the locking tab from engagement with the handgun and allowing the handgun to be removed from the holster. The bell crank discussed in this invention could also be replaced by a variety of devices that perform substantially the same function. These include, but are not limited to, devices such as cabling connections, including those that are utilized in bicycle braking and gearing configurations.

In the embodiment of the invention that utilizes a bell crank, also called a rotating bar attached to the crown of the holster, the release tab is attached to a release lever, with the release lever being a first class lever. It has a fulcrum in the center of the release lever, force is applied by the user at the first end of the lever, and motion is imparted at the second end of the release lever to move the rotating bar. Since the rotating bar is operatively connected to the locking tab, movement of the rotating bar also moves the locking tab. The locking tab is part of a locking lever, with the locking lever being a second class lever. It has a fulcrum on a first end, force is applied to the second end, and a motion is imparted to the locking tab located between the ends of the locking lever.

In another embodiment of the present invention, the linkage is configured to be placed beneath the gun and is configured to interact with the release tab so that when the release tab is pushed, the linkage will pull the locking tab out of its connected position with the ejection port and thus allow the handgun to be removed from the holster. A variety of types of material may be utilized to accomplish this task. These include cables, cable housings, and cranks similar to those utilized in bicycle braking devices as well as embodiments that utilize a bell crank.

In one embodiment of the device, the linkage is formed from a cable which is situated inside a cable housing. The cable is flexible, such as a steel cable. The cable housing is also flexible, and it has a first end attached adjacent to the release tab, and a second end attached adjacent to the locking tab. Thus when the release tab is depressed, that motion is transferred via the cable inside the cable housing to the locking tab, which is pulled out of engagement with the handgun feature, which is preferably the ejection port.

Another embodiment of the invention is a security holster which includes two generally parallel bars attached to the left and right side of the holster body. These bars are mounted so as to be rotatable. They are linked to each other with an articulated front linkage which passes in front of the barrel end of the holster. A release tab is fixedly attached to a first parallel bar, so that when the release tab moves, the first parallel bar rotates. A locking tab is fixedly attached to the second parallel bar. When the first parallel bar is rotated by pressing the release tab, the second parallel bar also rotates in an opposite direction of rotation, and moves the locking tab. The linkage between the two parallel bars is through the articulated front linkage. Depressing the release tab causes a clockwise rotation of the first parallel bar, when this bar is viewed from barrel end of the holster. This motion is imparted through the articulated front linkage and causes a counter-clockwise rotation of the second parallel bar, again when viewed from the barrel end of the holster. This causes release of the locking tab from the handgun feature, which is preferably the ejection port of a semi-automatic handgun. Release of the locking tab allows removal of the handgun from the holster.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
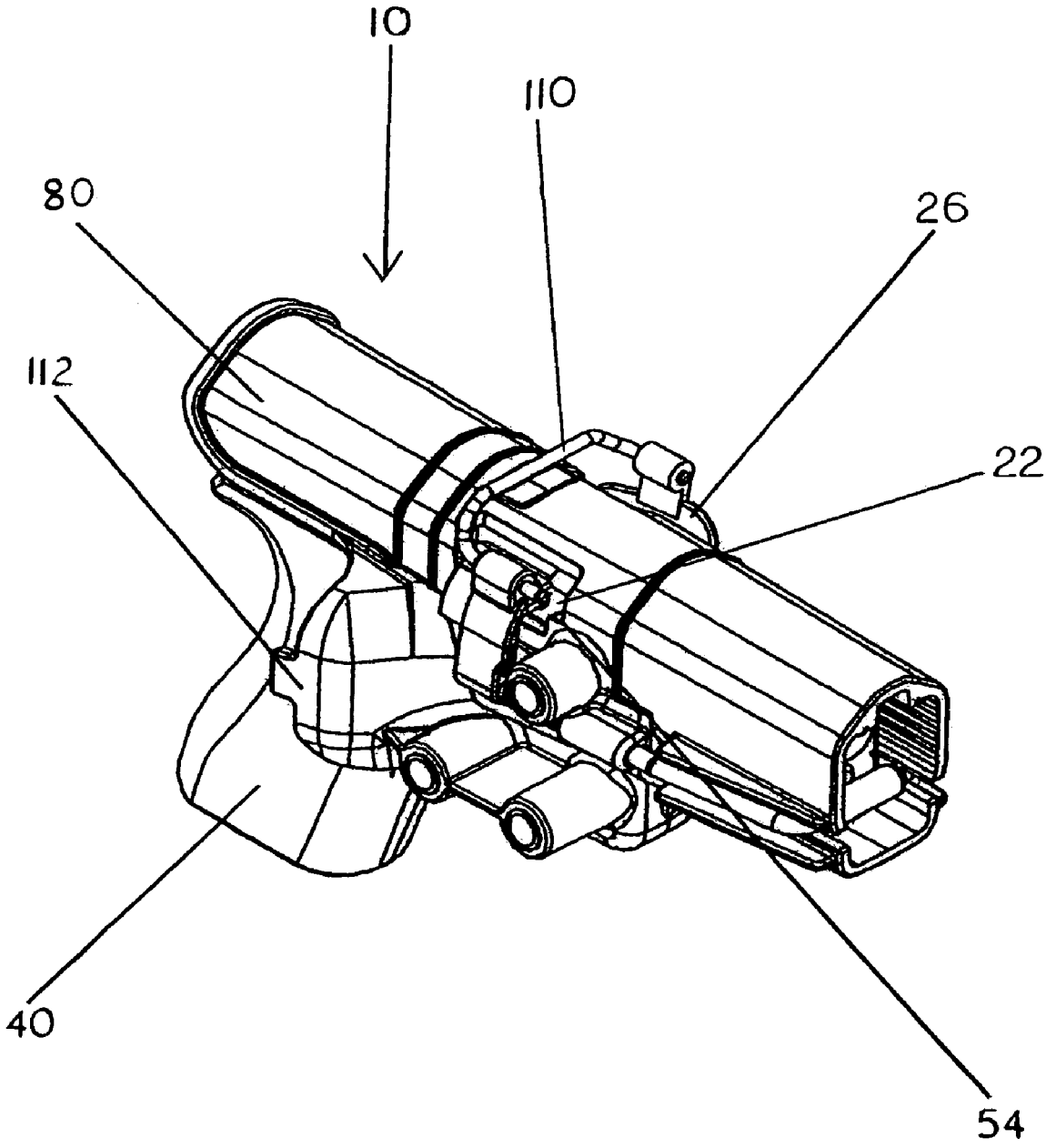
FIG. 1 is a perspective view of a left-handed linkage utilizing a rigid U-shaped bar.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Figure 2:
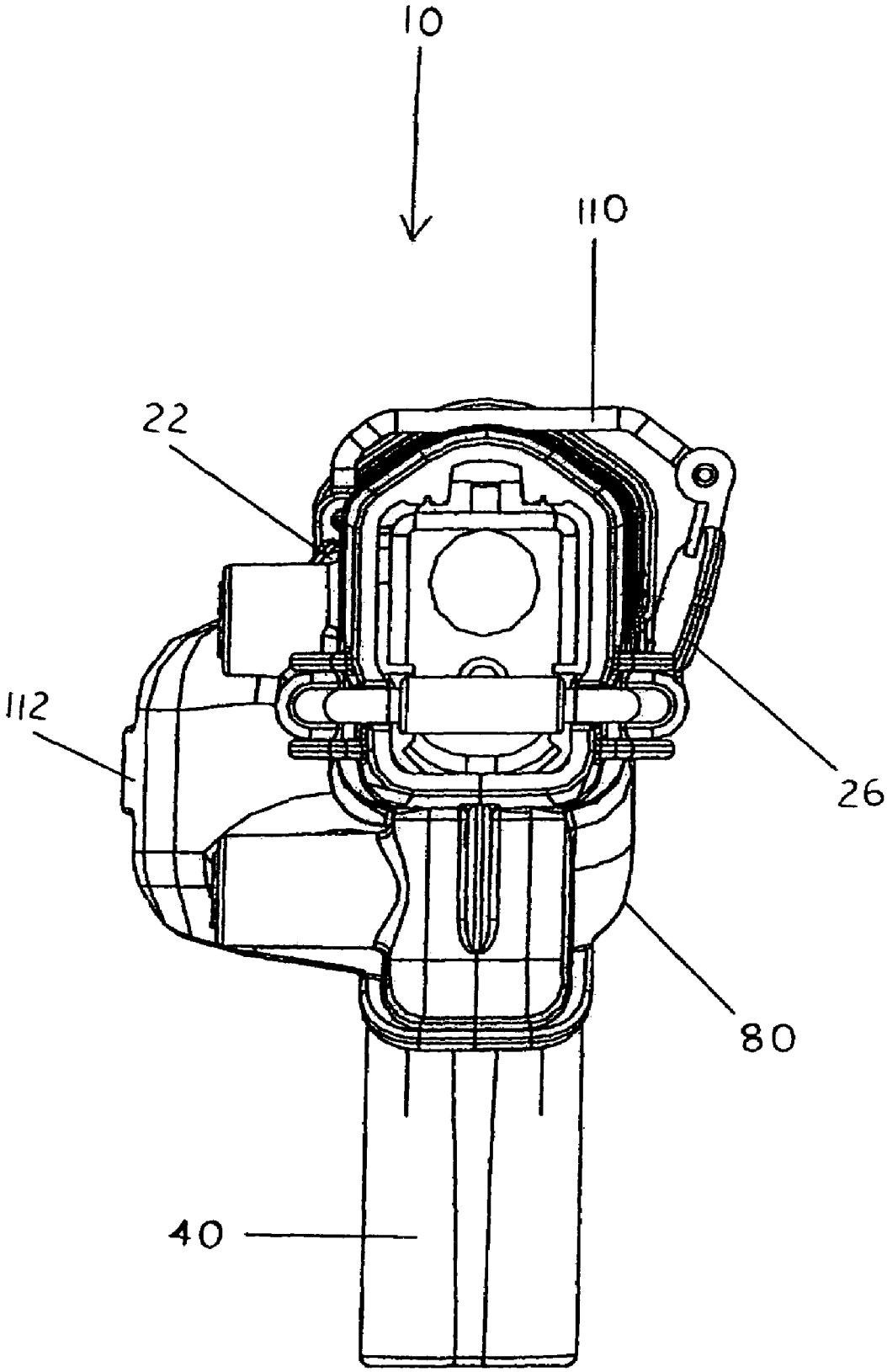
FIG. 2 is a front view of the U-shaped bar linkage.
Figure 3:
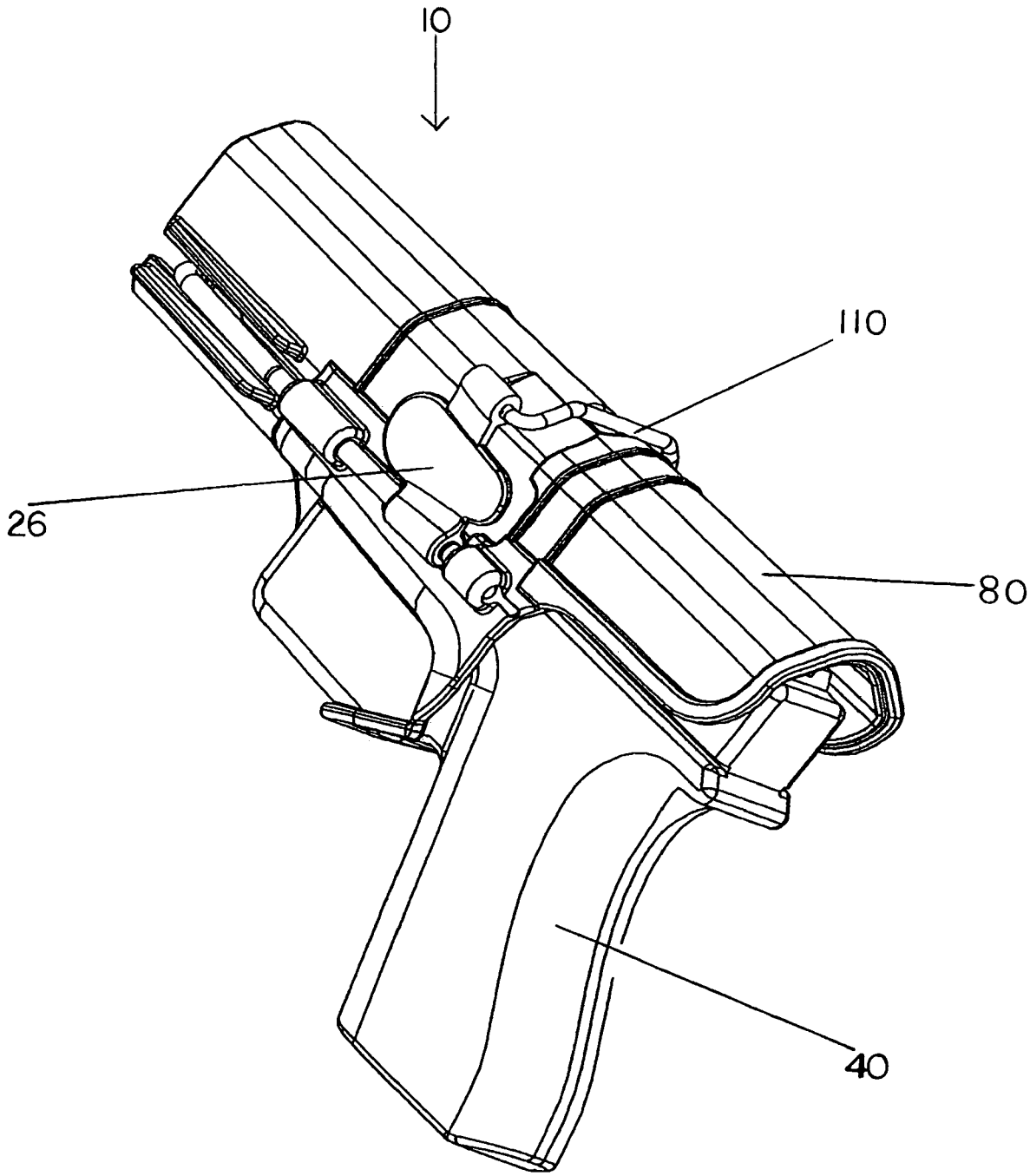
FIG. 3 is a perspective view of the U-shaped bar linkage.

Several preferred embodiments of the invention are shown in the FIGS. 1-15. Referring first to FIGS. 1-3, a first embodiment of the present invention is shown. In this first embodiment, a holster 10 having an inner shell 80 is configured to receive a handgun 40 therein. This handgun 40 has an ejection port 54, which is connected to a locking tab 22. This locking tab 22 is configured to be releasably engaged and disengaged from the ejection port 54, or other feature of the handgun. The locking tab 22 is connected to a release tab 26 by a rigid U-shaped rod linkage 110. In this embodiment, the linkage is configured to go over the top or crown of the holster 10. However, as is shown in other embodiments and configurations, this linkage can also be configured to pass under the holster. See for example FIGS. 5 and 6.

The linkage 110 is configured to transfer movement of the release tab 26 on the left side of the holster to the locking tab 22 on the right side. In one of the embodiments, this is accomplished by providing one or more hinges that transfers the inward movement of the release tab by the index finger of the user to an outward movement of the locking tab 22 by the linkage. While a hinge is shown in one embodiment of the invention, it is to be distinctly understood that the invention is not limited thereto but may be variously embodied to include other features and types of inventions as well. These include, but are not limited to, the use of springs, tensioning devices, cable relays, bell cranks, and other similar devices.

The present invention also provides an optional thumb sheath 112, which prevents the entanglement of the thumb with the functioning mechanism of the locking device and the linkage. In addition, spacer devices are utilized to maintain proper spacing between the holster 10 and the duty belt (not shown) or other feature that would be proximate to the body of the user.

Figure 4:
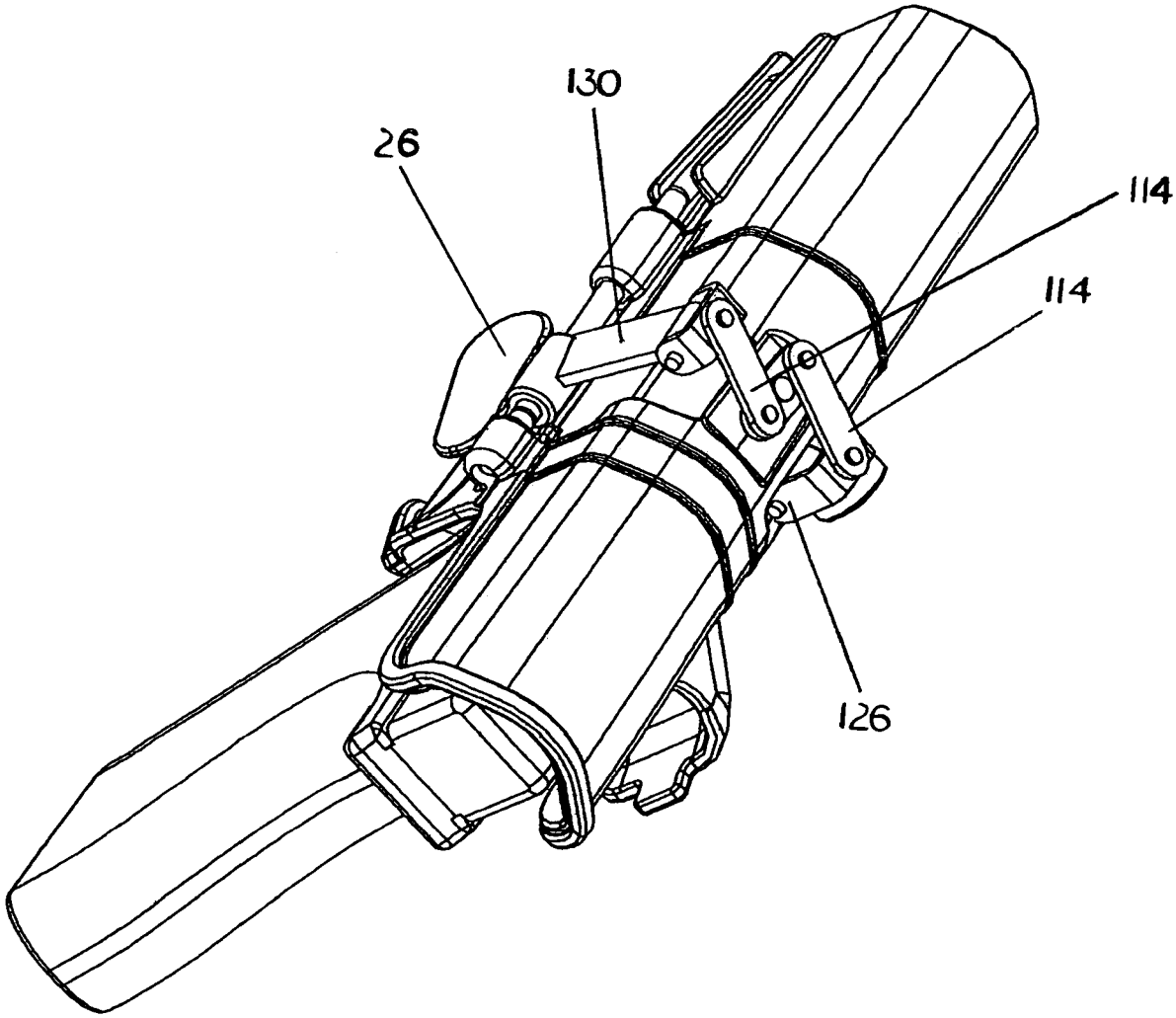
FIG. 4 is a perspective view of the bell crank linkage.
Figure 5:
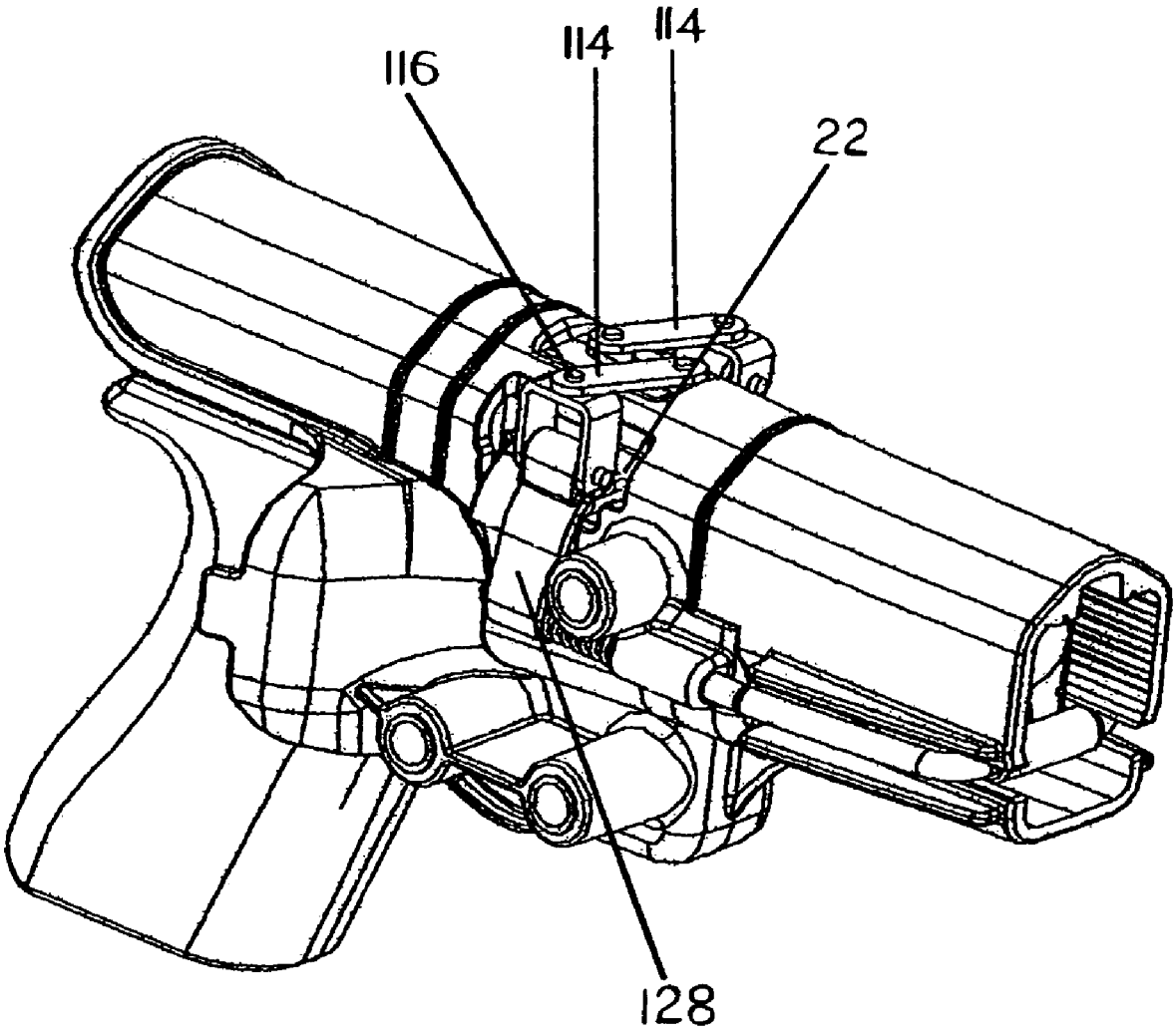
FIG. 5 is a perspective view of the bell crank linkage.
Figure 6:
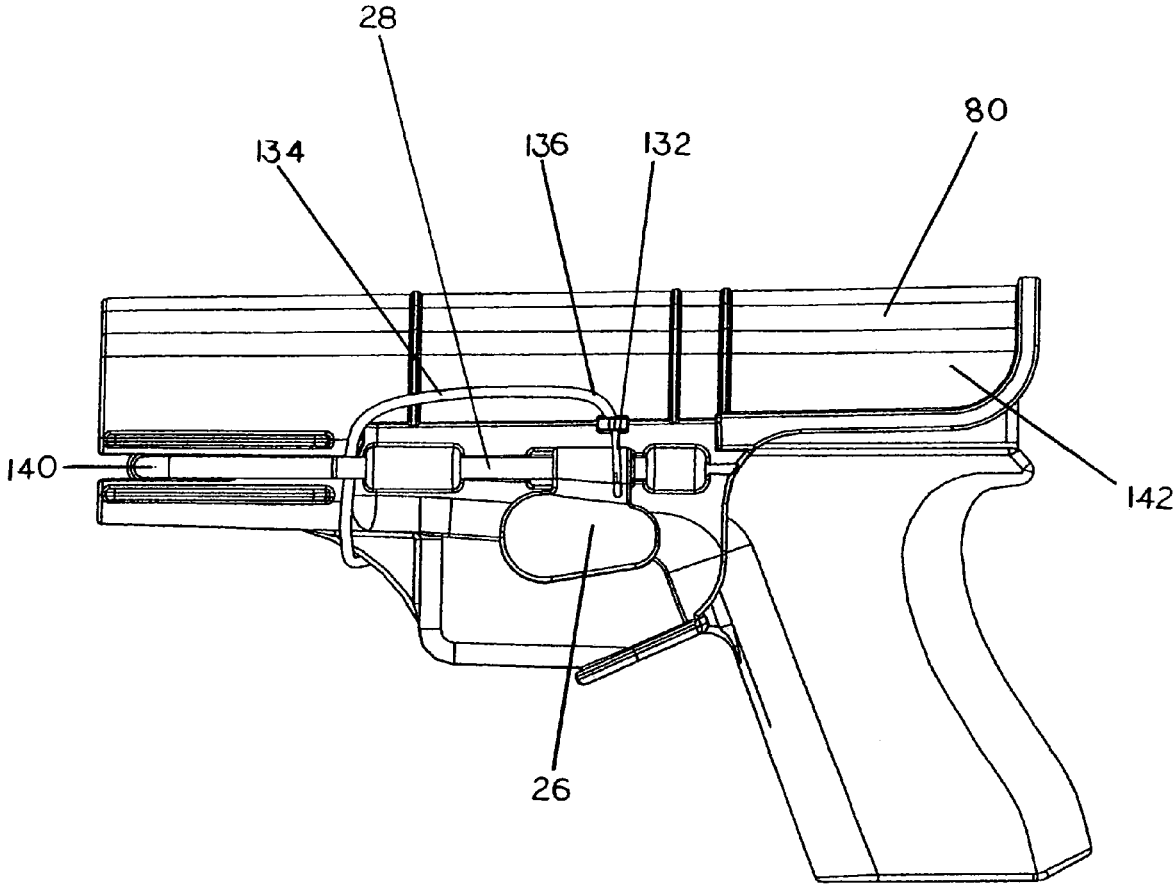
FIG. 6 is a side view of a cable and cable housing linkage.

A second preferred embodiment of the present invention is found in FIGS. 4-5. In this embodiment, the linkage is made up of a pair of connecting rods 114 that are connected to a bell crank 116, also called a rotating plate. The combination of the connecting rods 114 and the bell crank 116 transfer movement from the release lever 130 over to the locking tab 22. This occurs because the inward movement of the release lever 130 causes the connecting rod 114 connected to it to move. This movement of the first connecting rod 114 causes the bell crank 116 to pivot, thus causing a pull on the second connecting rod 114. As the second connecting rod 114 is pulled toward the bell crank 116, the locking lever 128, which is connected to the bell crank 116, is then pulled out of position against the ejection port of the handgun 40. The handgun can then be released from its position within the holster.

In the attached photographs (FIGS. 10-15), one of the embodiments of the present invention includes an articulated U-shaped rod and a hinge. This hinge allows the linkage to wrap over the top portion of the gun and also provides a pivot point whereupon force from pressing the release tab 26 can be transferred to the hinge and creates a motion that pulls the locking tab 22 out of engagement with the device. The present invention allows individuals who are naturally left handed to utilize security holsters that are configured for persons who are right handed by providing an operative linkage to engage and use those security holsters.

Figure 7:
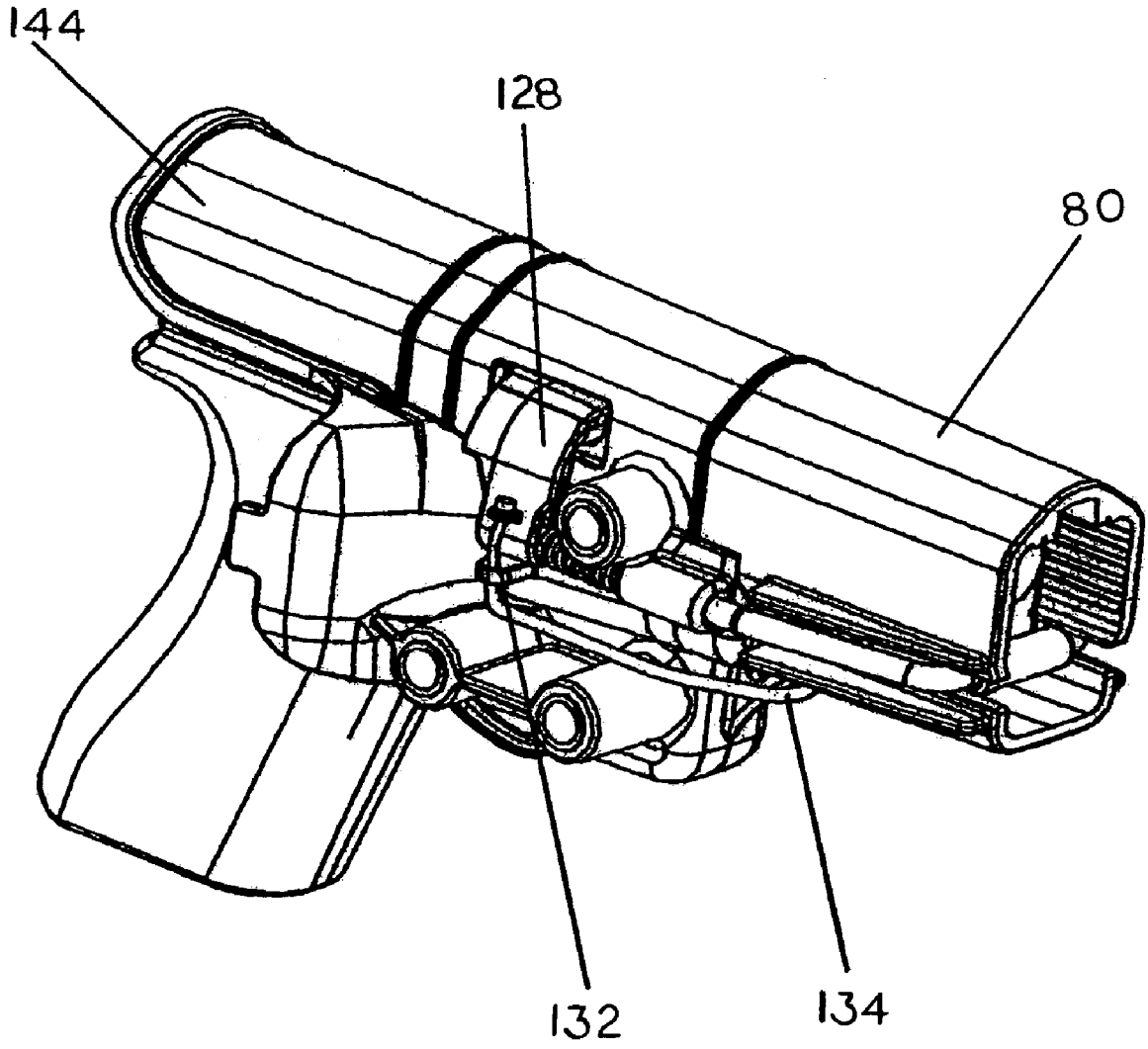
FIG. 7 is a perspective view of a cable and cable housing linkage.

Preferred third and fourth embodiments of the present invention are shown in FIGS. 6-9. In the embodiment shown in FIG. 6, the linkage means is not configured to go over the top portion of the holster 10, as is shown in the prior embodiments. Rather, the linkage is configured to go beneath the handgun holster. In the preferred embodiment, shown in FIG. 6, a cable 132 is enclosed within a cable housing 134. The cable and cable housing have a first end 136 and a second end 138. The first end 136 of the cable housing 134 is attached adjacent to the release tab 26. The release tab 26 is rotatably attached to a U-shaped tube 140 and includes a spring 28. The cable 132 and cable housing 134 pass from the left side 142 of the holster inner shell 80 to the right side 144, which is shown in FIG. 7. This cable housing 130 extends below the holster and reaches over to the other side, thus allowing movement of the locking tab 22 when the release tab 26 is activated. This cable is configured to be appropriately tensioned by the release tab 26 and then to transfer movement from the release tab 26 to the locking tab 22 in such a way so as to pull the locking tab 22 from its position against the ejection port 54 of the handgun. This then allows for the handgun 40 to be released and available for use.

Figure 8:
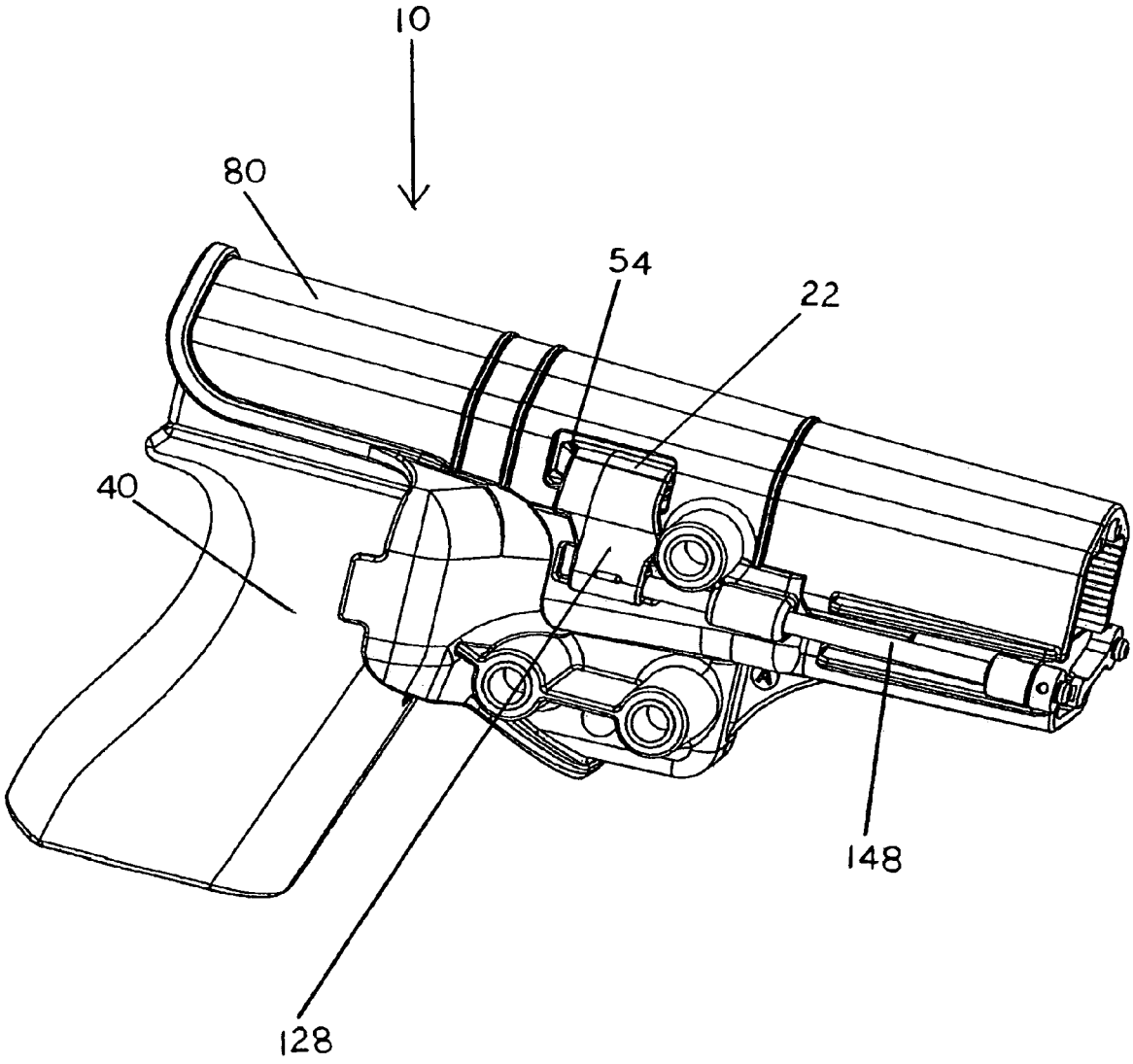
FIG. 8 is a perspective view of an articulated front linkage.
Figure 9:
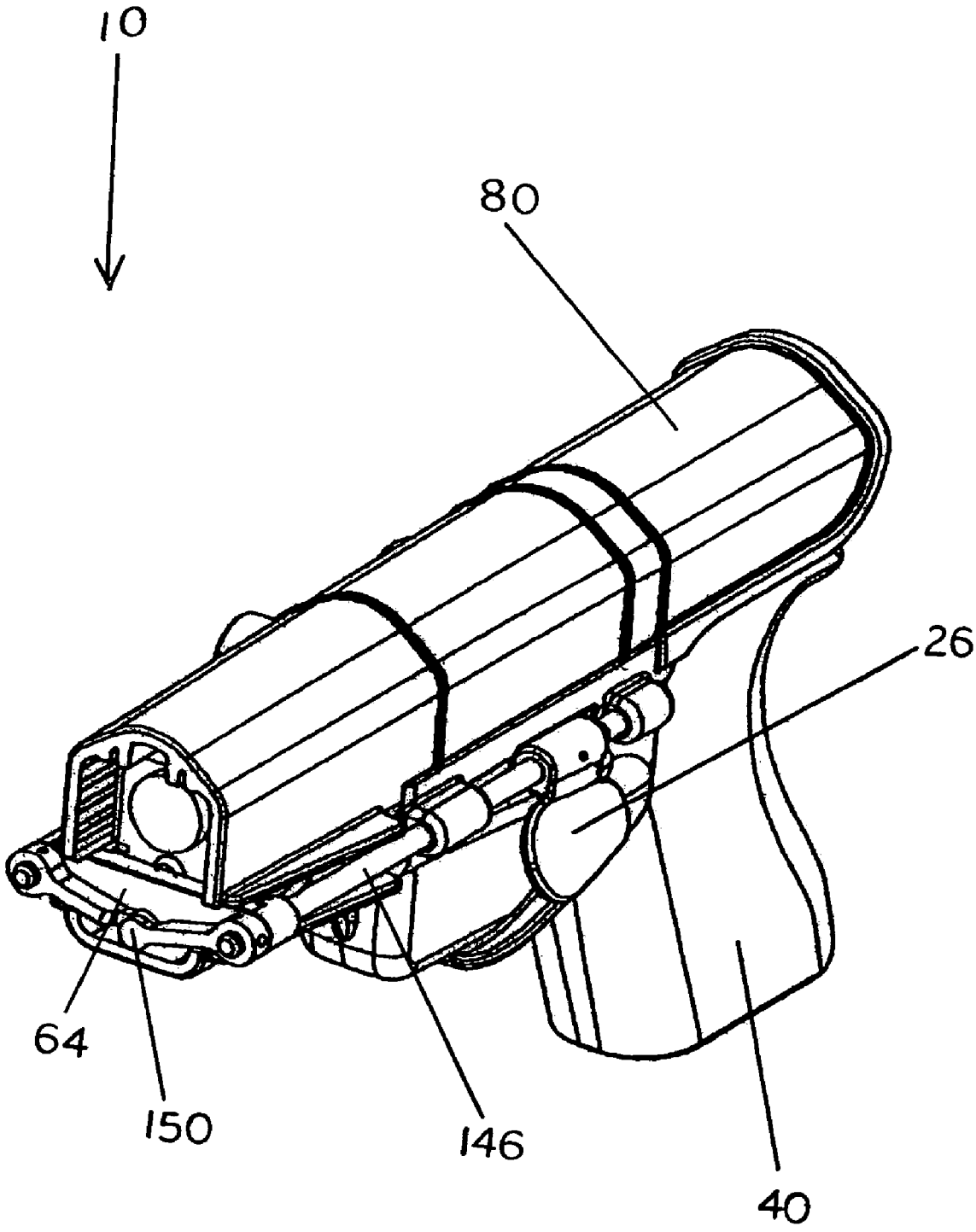
FIG. 9 is a perspective view of an articulated front linkage.
Figure 10:
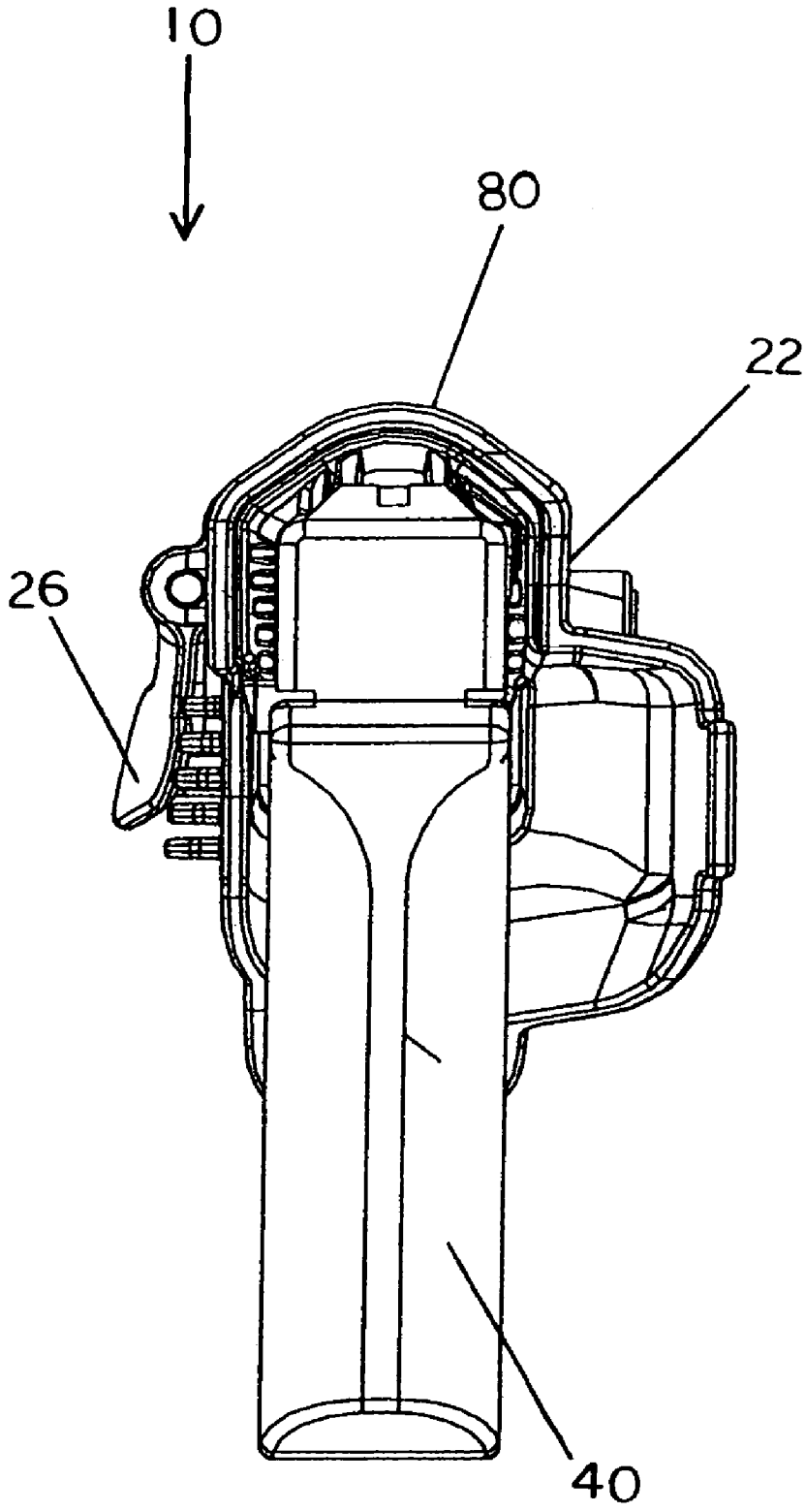
FIG. 10 is a view of an articulated U tube left-handed linkage.
Figure 11:
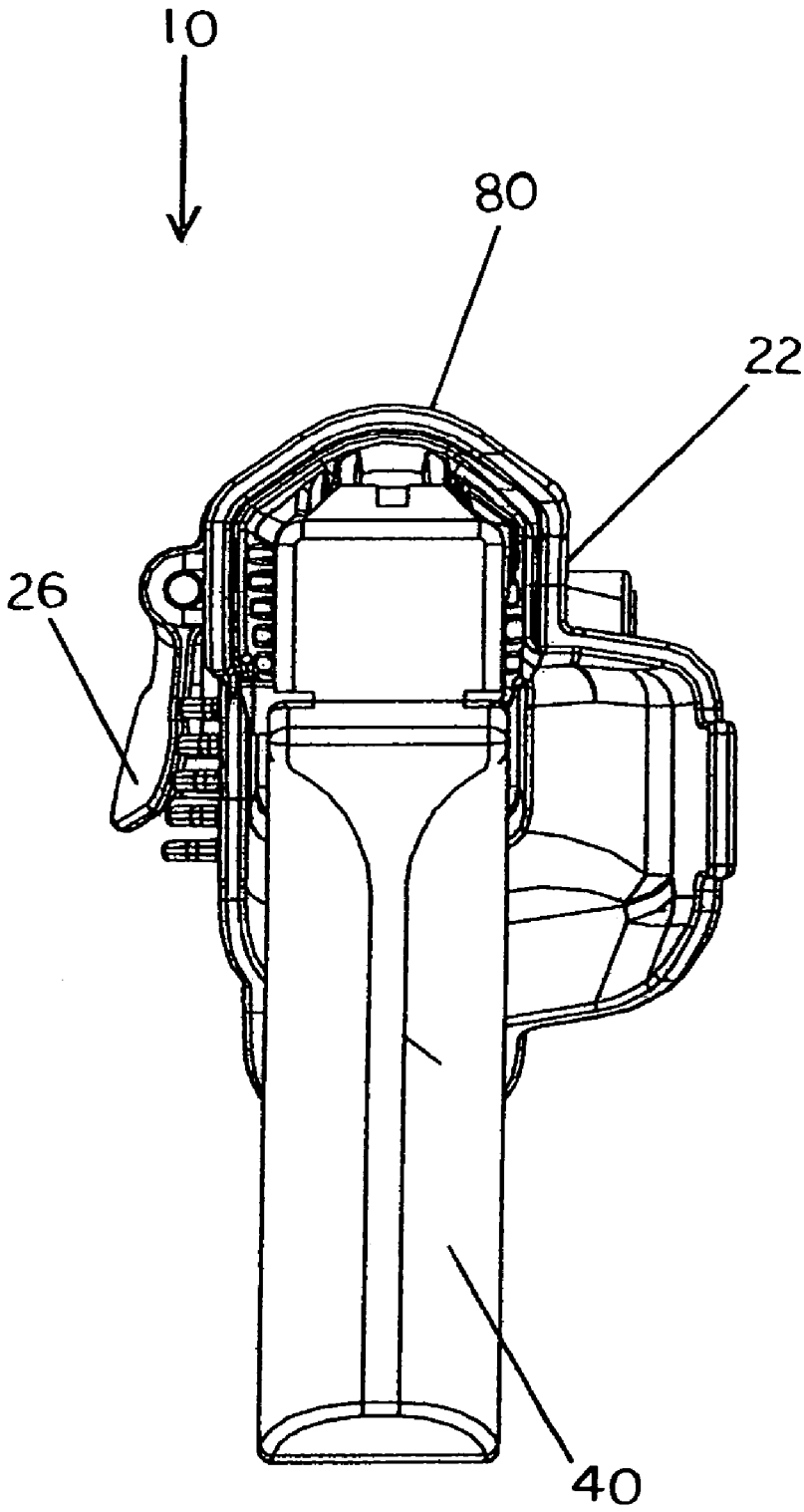
FIG. 11 is a rear view of an articulated U tube left-handed linkage.
Figure 12:
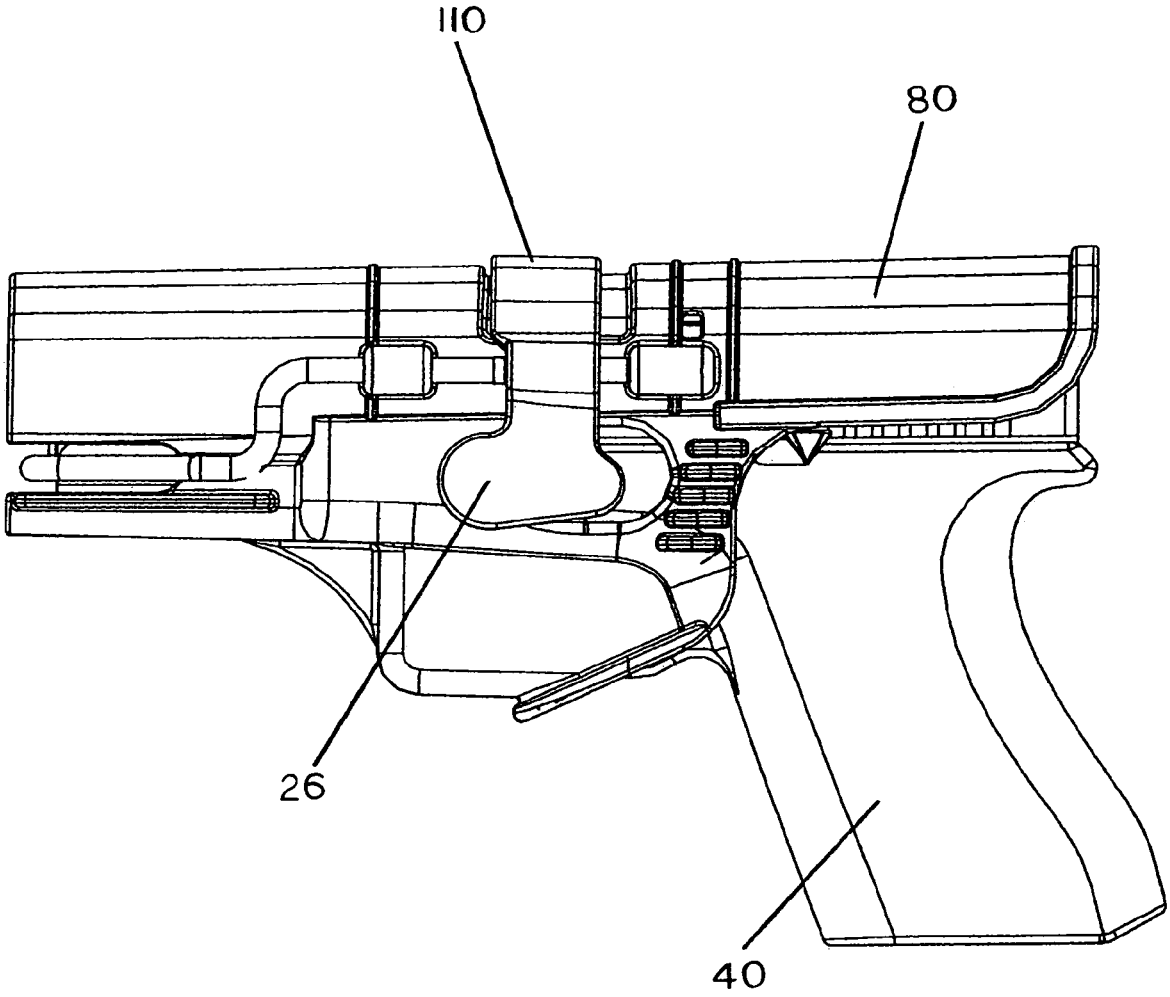
FIG. 12 is a view of the left side of an articulated U shape linkage.
Figure 13:
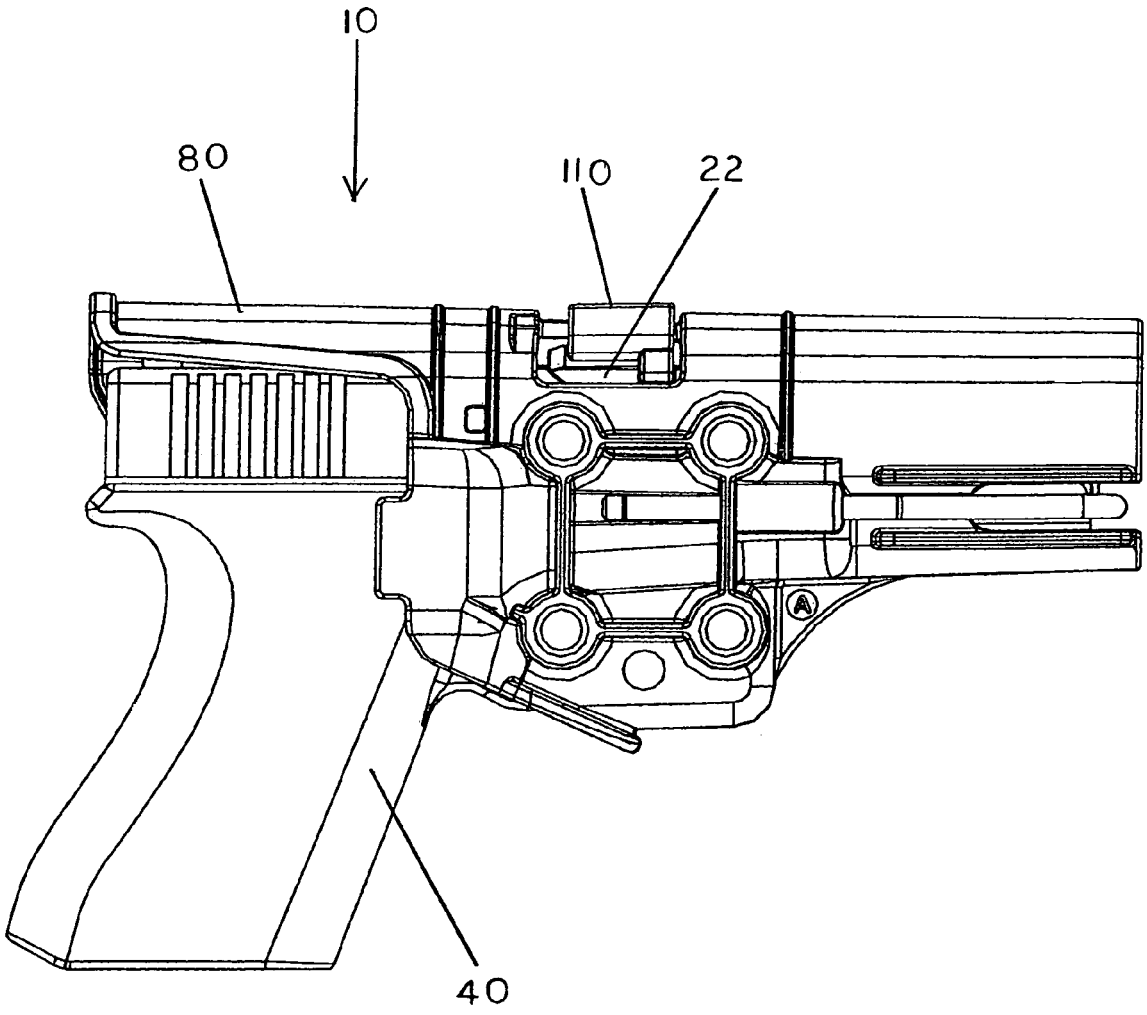
FIG. 13 is a view of the right side of an articulated U shape linkage.
Figure 14:
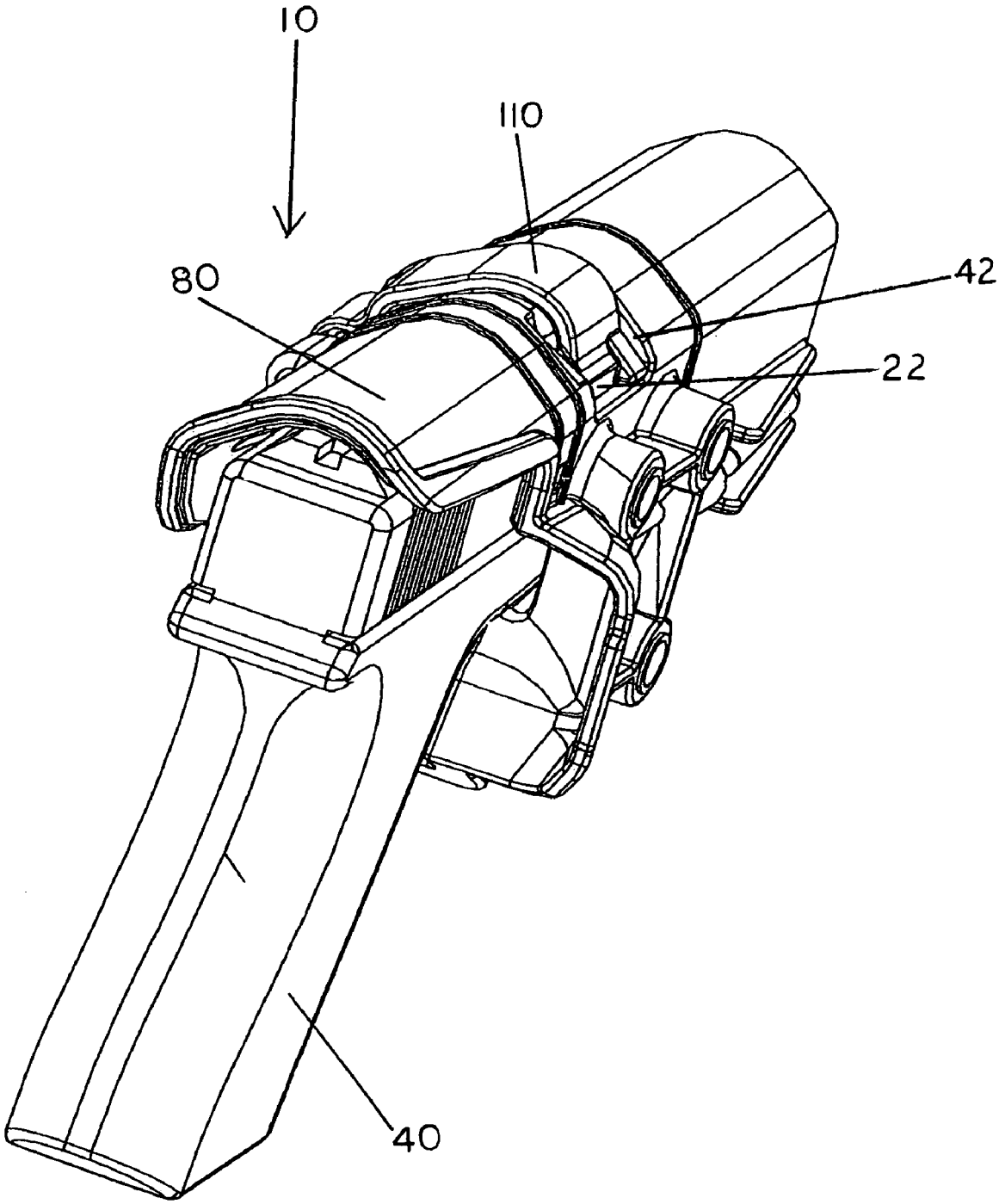
FIG. 14 is a perspective view of the right side of security holster with an articulated left-handed linkage, showing the locking tab disengaged.
Figure 15:
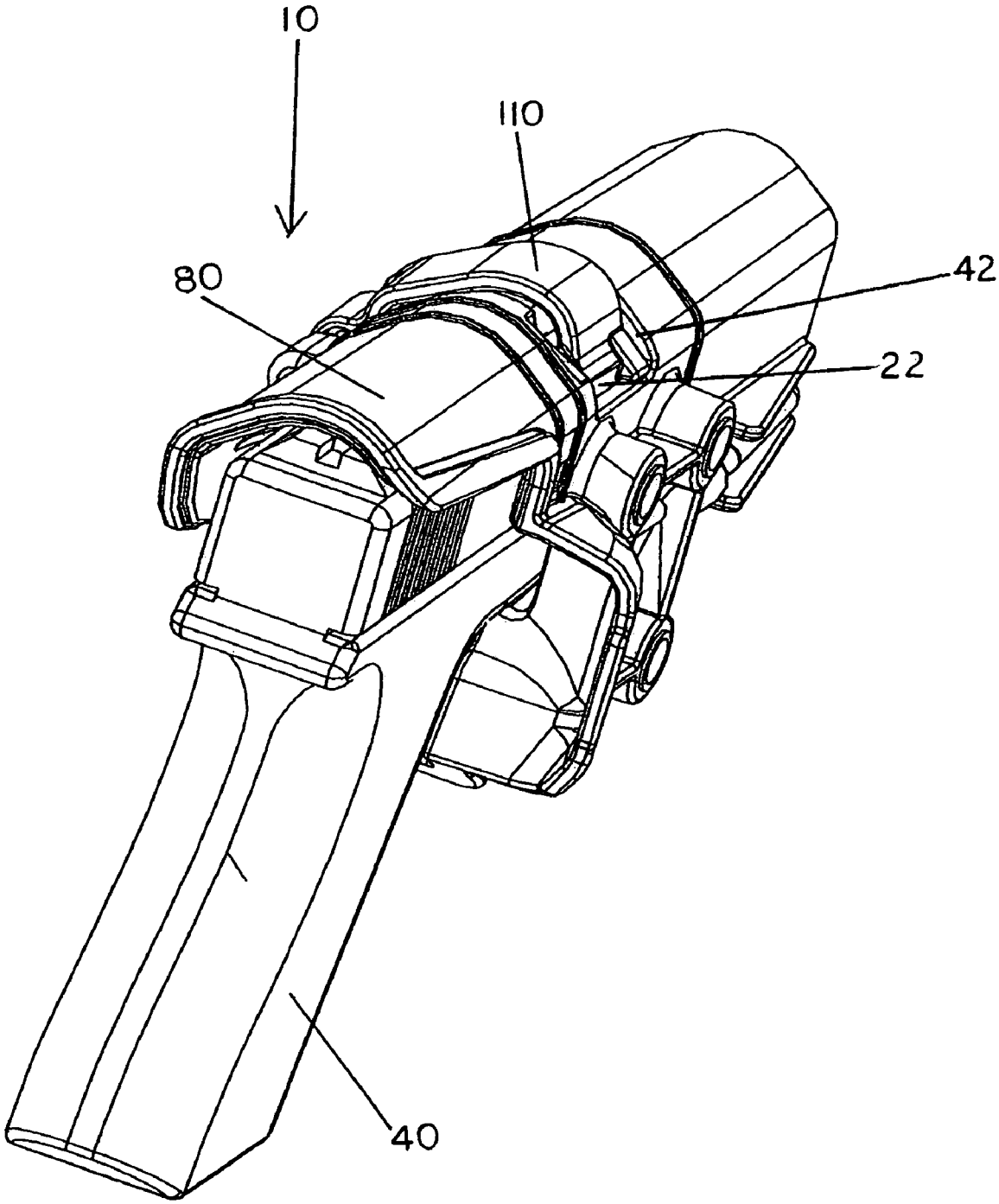
FIG. 15 is a perspective view of the right side of the holster with an articulated U shaped linkage, showing the locking tab engaged.

Another embodiment of the invention is shown in FIGS. 8 and 9. This embodiment of the invention includes a first parallel rod 146 shown in FIG. 9, and a second parallel rod 148, shown in FIG. 8. The release tab 26 is rigidly attached to the first parallel rod 146, so that when the release tab is pressed, the first parallel rod 146 rotates in a clockwise rotation, as seen from the view looking at the barrel end 64 of the invention. The locking lever 128, with its attached locking tab 22, is rigidly attached to the second parallel rod 148. As the second parallel rod 148 is caused to rotate in a counterclockwise direction, the locking tab 22 is rotated away from engagement with the ejection port 54 of the handgun. The first and second parallel rods, 146 and 148 are operatively connected by an articulated front linkage 150. With this linkage, when the parallel rod 146 rotates in a clockwise direction, this motion is imparted to the second parallel rod 148 so that it rotates in an opposite direction that is counterclockwise.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

We claim:

1. A security holster configured for use with a handgun, said handgun having an ejection port, slide, handle, trigger, a barrel, and trigger guard, said holster configured for use by left handed individuals; said holster comprising:

a holster body, said holster body including inner and outer spaced substantially rigid sidewalls formed to define an inner cavity and an open top portion for receiving said handgun therein and for removing said handgun therefrom, with the outer sidewall forming a left side of said holster inner shell, and said inner sidewall forming a right side of said holster inner shell, and said inner shell having a holster crown adjacent to a handgun barrel when said handgun is secured in said holster:

a locking tab movably attached to a right side of said holster body, said locking tab configured to admit said handgun into said security holster body, and upon insertion of said handgun into said holster body, to engage said eiection port of said handgun until released, thereby preventing the withdrawal of said handgun prior to release of said locking tab; and a release tab on the left side of said holster body, configured to release said locking tab from said hand gun feature by moving said locking tab in relation to said holster, said release tab operationally connected to said locking tab through a linkage, with said linkage configured to disengages said locking tab from said eiection port by moving said locking tab away from said handgun feature in which said linkage further comprises a generally U-shaped rigid release tube configured to move laterally over the top of a holster crown, from the right side of the holster to the left side of the holster, hingedly attached on a first end to said release tab on said left side of said holster body, and hingedly attached on a second end to said locking tab, and configured to extend from said left side of said holster body, to said right side of said holster body, with said tube positioned and configured so that rotational movement of said release tab causes said attached U-shaped release tube to move laterally over said holster crown and to cause said locking tab to rotate away from said ejection port, thus releasing said handgun for removal from said holster;

said security holster configured to allow one handed insertion of said handgun into said security holster, wherein said locking tab admits said handgun into said holster during insertion and wherein said locking tab moves into engagement with a feature of said handgun to retain said handgun within said holster until said locking tab is moved out of engagement by activation of said release tab, thereby providing said security holster with one handed insertion, one finger release of said handgun, and one handed withdrawal of said handgun after pressing said release tab and moving said locking tab from engagement with said handgun feature.

2. The security holster of claim 1 in which said release lever is a third class lever, with a fulcrum at a first end, a force applied by the user in the middle, and motion imparted at the second end of the release lever to move said u-shaped release tube.

3. The security holster of claim 1 in which said locking lever is a second class lever, with a fulcrum on a first end of a locking lever, a force applied to a second end of said locking lever, and motion imparted to a locking tab between said ends.

4. A security holster configured for use with a handgun, said handgun having an ejection port, slide, handle, trigger, a barrel, and trigger guard, said holster configured for use by left handed individuals; said holster comprising:

a holster body, said holster body including inner and outer spaced substantially rigid sidewalls formed to define an inner cavity and an open top portion for receiving said handgun therein and for removing said handgun therefrom, with the outer sidewall forming a left side of said holster inner shell, and said inner sidewall forming a right side of said holster inner shell, and said inner shell having a holster crown adjacent to a handgun barrel when said handgun is secured in said holster:

a locking tab movably attached to said holster body, said locking tab configured to admit said handgun into said security holster body, and upon insertion of said handgun into said holster body, to engage a feature of said handgun until released, thereby preventing the withdrawal of said handgun prior to release of said locking tab; and a release tab on the left side of said holster body, configured to release said locking tab from said hand gun feature by moving said locking tab in relation to said holster, said release tab operationally connected to said locking tab through a linkage, with said linkage configured to disengage said locking tab from said handgun feature by moving said locking tab away from said handgun feature, in which said linkage includes a rotating bar attached to a crown of said holster, with said release tab operationally connected to a first end of said rotating bar, and side locking tab operationally connected to said second end of said rotating bar, with said release tab attached to a left side of said holster body, and said locking tab attached to said right side of said holster body, so that when said release tab is pressed, motion is imparted to said rotating bar, which imparts motion to move said release tab from engagement with said handgun feature, thus releasing said handgun for removal from said holster;

said security holster configured to allow one handed insertion of said handgun into said security holster, wherein said locking tab admits said handgun into said holster during insertion and wherein said locking tab moves into engagement with a feature of said handgun to retain said handgun within said holster until said locking tab is moved out of engagement by activation of said release tab, thereby providing said security holster with one handed insertion, one finger release of said handgun, and one handed withdrawal of said handgun after pressing said release tab and moving said locking tab from engagement with said handgun feature.

5. The security holster of claim 4 in which said release lever is a first class lever, with a fulcrum in the center of said release lever, a force applied by the user at a first end of said lever, and motion imparted at the second end of the release lever to move said rotating bar.

6. The security holster of claim 4 in which said locking lever is a second class lever, with a fulcrum on a first end of a locking lever, a force applied to a second end of said locking lever, and motion imparted to a locking tab between said ends.

7. A security holster configured for use with a handgun, said handgun having an eiection port, slide, handle, trigger, a barrel, and trigger guard, said holster configured for use by left handed individuals; said holster comprising:

a holster body, said holster body including inner and outer spaced substantially rigid sidewalls formed to define an inner cavity and an open top portion for receiving said handgun therein and for removing said handgun therefrom, with the outer sidewall forming a left side of said holster inner shell, and said inner sidewall forming a right side of said holster inner shell, and said inner shell having a holster crown adjacent to a handgun barrel when said handgun is secured in said holster:

a locking tab movably attached to said holster body, said locking tab configured to admit said handgun into said security holster body, and upon insertion of said handgun into said holster body, to engage a feature of said handgun until released, thereby preventing the withdrawal of said handgun prior to release of said locking tab; and a release tab on the left side of said holster body, configured to release said locking tab from said hand gun feature by moving said locking tab in relation to said holster, said release tab operationally connected to said locking tab through a linkage, with said linkage configured to disengage said locking tab from said handgun feature by moving said locking tab away from said handgun feature I linkage includes two rotatable and generally parallel bars attached to said holster body and linked to each other with an articulated front linkage, with a release tab fixedly attached to a first parallel bar, and a locking tab fixedly attached to a second parallel bar, so that when said first parallel bar is rotated by pressing said release tab, said second parallel bar is caused to move in an opposite rotation to move said locking tab, by movement of said pair articulated front linkages said security holster configured to allow one handed insertion of said handgun into said security holster, wherein said locking tab admits said handgun into said holster during insertion and wherein said locking tab moves into engagement with a feature of said handgun to retain said handgun within said holster until said locking tab is moved out of engagement by activation of said release tab, thereby providing said security holster with one handed insertion, one finger release of said handgun, and one handed withdrawal of said handgun after pressing said release tab and moving said locking tab from engagement with said handgun feature.

8. The security holster of claim 7 in which depressing said release tab causes a clockwise rotation of said first parallel bar when viewed from the barrel end of said holster.

9. The security holster of claim 7 in which said depressing said release tab causes a clockwise rotation of said first parallel bar when viewed from the barrel end of said holster, and the motion imparted through said articulated front linkage causes a counterclockwise rotation of said second parallel bar when viewed from the barrel end of said holster, thus causes release of said locking tab from said handgun feature, and release of said handgun for removal from said holster.

10. A security holster configured for use with a handgun, said handgun having an ejection port, slide, handle, trigger, a barrel, and trigger guard, said holster configured for use by left handed individuals; said holster comprising:

a holster body, said holster body including inner and outer spaced substantially rigid sidewalls formed to define an inner cavity and an open top portion for receiving said handgun therein and for removing said handgun therefrom, with the outer sidewall forming a left side of said holster inner shell, and said inner sidewall forming a right side of said holster inner shell, and said inner shell having a holster crown adjacent to a handgun barrel when said handgun is secured in said holster:

a locking tab movably attached to said holster body, said locking tab configured to admit said handgun into said security holster body, and upon insertion of said handgun into said holster body, to engage a feature of said handgun until released, thereby preventing the withdrawal of said handgun prior to release of said locking tab; and a release tab on the left side of said holster body, configured to release said locking tab from said hand gun feature by moving said locking tab in relation to said holster, said release tab operationally connected to said locking tab through a linkage, with said linkage configured to disengages said locking tab from said handgun feature by moving said locking tab away from said handgun feature, wherein said linkage includes a flexible cable and a cable housing fixed at a first end and a second end of said cable housing, with said first end of said cable operatively linked to said release tab, with a first end of said cable housing attached adjacent to said release tab, and said second end of said cable attached to said locking tab, with said second end of said cable housing attached adjacent to said locking tab, so that when said release tab is depressed, said cable is tensioned inside said cable housing, and motion is imparted to said locking tab, causing said locking tab to rotate out of engagement with said handgun feature;

said security holster configured to allow one handed insertion of said handgun into said security holster, wherein said locking tab admits said handgun into said holster during insertion and wherein said locking tab moves into engagement with a feature of said handgun to retain said handgun within said holster until said locking tab is moved out of engagement by activation of said release tab, thereby providing said security holster with one handed insertion, one finger release of said handgun, and one handed withdrawal of said handgun after pressing said release tab and moving said locking tab from engagement with said handgun feature.

11. The security holster of claim 1 in which said u-shaped and articulated release tube includes a pair of hinges, and extends over said crown of said holster body.

12. The security holster of claim 10 in which said release lever tab is a third class lever, with a fulcrum at a first end, a force applied by the user in the middle of said lever, and motion imparted at the second end of the release lever to move said u-shaped articulated release tube.

13. The security holster of claim 10 in which said locking tab is a second class lever, with a fulcrum on a first end of a locking lever, a force applied to a second end of said locking lever, and motion imparted to said locking tab between said ends.

* * * * *